US008763318B1

(12) United States Patent
Bobbitt

(10) Patent No.: US 8,763,318 B1
(45) Date of Patent: Jul. 1, 2014

(54) GRAVE MARKER ASSEMBLY

(76) Inventor: Gary Bobbitt, San Bernardino, CA (US)

( * ) Notice: Subject to any disclaimer, the term of this patent is extended or adjusted under 35 U.S.C. 154(b) by 0 days.

(21) Appl. No.: 12/947,576

(22) Filed: Nov. 16, 2010

(51) Int. Cl.
*E04H 13/00* (2006.01)

(52) U.S. Cl.
USPC ..... 52/103; 52/139; 52/711; 27/30; 40/124.5

(58) Field of Classification Search
USPC ..... 52/103, 133, 135–137, 139, 140, 704, 52/707, 710, 711; 27/30, 35; 40/124.5
See application file for complete search history.

(56) References Cited

U.S. PATENT DOCUMENTS

| | | | | |
|---|---|---|---|---|
| 623,943 | A * | 4/1899 | Campbell | 52/103 |
| 2,213,187 | A * | 9/1940 | Donahey | 27/35 |
| 2,341,777 | A * | 2/1944 | Hensel | 52/598 |
| 3,378,942 | A * | 4/1968 | Diamond et al. | 40/124.5 |
| 3,604,172 | A * | 9/1971 | Matvey | 52/103 |
| 3,650,072 | A * | 3/1972 | Matvey | 52/102 |
| 3,758,999 | A * | 9/1973 | Matvey | 52/103 |
| 4,545,167 | A * | 10/1985 | Brock | 52/509 |
| 4,607,417 | A * | 8/1986 | Hancovsky | 27/1 |
| 4,638,618 | A * | 1/1987 | Iesaka et al. | 52/509 |
| 5,287,603 | A * | 2/1994 | Schorman | 27/1 |
| 5,595,029 | A * | 1/1997 | Revoir et al. | 52/103 |
| 5,746,030 | A | 5/1998 | Sannipoli, Sr. | |
| 6,088,955 | A * | 7/2000 | Nelson et al. | 47/41.1 |
| 6,243,997 | B1 | 6/2001 | Sannipoli | |
| 7,337,585 | B1 | 3/2008 | Bobbitt | |
| 7,356,891 | B2 * | 4/2008 | Freeman | 27/35 |
| 7,530,149 | B1 | 5/2009 | Bobbitt | |
| 2002/0007601 | A1 * | 1/2002 | England | 52/103 |

FOREIGN PATENT DOCUMENTS

| | | | | |
|---|---|---|---|---|
| FR | 2548743 | A1 * | 1/1985 | E04H 13/00 |

* cited by examiner

*Primary Examiner* — Adriana Figueroa
(74) *Attorney, Agent, or Firm* — Knobbe, Martens, Olson & Bear, LLP

(57) ABSTRACT

A grave marker assembly that can be removably mounted and secured to a support surface such as a lawn crypt lid. The grave marker assembly has a fastening system that is not exposed to view and yet allows the grave marker to be easily installed and removed. The fastening system includes a channel and interior opening formed on a base member that is adapted to receive a fastener. The fastener in turn is adapted to be inserted into an opening formed on the crypt lid or other support surface. The assembly further includes a multi-function frame disposed along the outer periphery of the memorial marker that can serve as a decorative feature and draining functions.

11 Claims, 7 Drawing Sheets

GRAVE MARKER ASSEMBLY

BACKGROUND OF THE INVENTION

1. Field of the Invention

This invention relates generally to grave site markers, and more particularly, to a grave marker assembly that can be removably mounted and secured to lawn crypt lids or other support surfaces.

2. Description of the Related Art

In an effort to conserve cemetery space, the traditional practice of excavating individual grave sites for interment of each casket has been gradually replaced by the use of lawn crypts. Lawn crypts generally refer to an array of burial vaults installed below ground and positioned side-by-side in rows. Each crypt is typically a rectangular, concrete enclosure that may be of single or double depth and configured to enclose one or more caskets therein. The crypts are usually spaced in close proximity to one another to provide efficient use of cemetery space.

The lawn crypts are typically covered by concrete lids configured to fit over the opening of the crypt. The crypt lids are in turn covered by soil and lawn that are flush with the ground. A double depth lawn crypt is described in U.S. Pat. No. 5,746,030 to Sannipoli, while a modified lid for such a crypt, incorporating a headstone support, is described in U.S. Pat. No. 6,243,997. A lawn crypt covering system is described in U.S. Pat. Nos. 7,530,149 and 7,337,585. The entirety of each of these patents is hereby incorporated by reference.

Grave markers such as memorial plaques are usually used to mark grave sites and identify the deceased who are buried at the site. Grave markers for lawn crypts are typically horizontal tablets or slabs engraved with the names, dates of birth and death, and other information of the deceased. The tablets or slabs can be made of a variety of different materials, such as granite, marble, stone, or concrete. They are usually set on a thick concrete block and anchored in the ground with the upper surface of the marker exposed. In order to add additional names to or change the marker, the marker must be removed by excavating the surrounding earth. Because the grave marker is set in soil with no securing mechanism, vandals and thieves can easily remove the grave marker by simply digging it out of the ground.

In view of the foregoing, there is a need for an improved grave marker assembly that can be removably mounted and secured to lawn crypts and other support surfaces.

SUMMARY OF THE INVENTION

The present disclosure provides a grave marker assembly adapted for removably mounting and securing a grave marker to a grave site structure such as a lawn crypt lid. The assembly is designed to permit ease of mounting or removal of the grave marker from the grave site, while at the same time providing a mechanism to secure the grave marker to the grave site in a manner such that the marker cannot be easily removed by vandals and thieves. The grave marker assembly is also designed with a drainage system to drain rain water and such from the upper surface of the grave marker.

In one embodiment, the grave marker assembly is configured with a fastening system that allows the assembly to be easily installed and removed from a support surface such as a lawn crypt lid. The fastening system comprises a channel formed on a lower surface of the assembly wherein the channel is formed to receive a retainer such as a fastening screw and to secure the retainer at a location interior to the outer edge of the assembly. The retainer in turn can be inserted into an opening on the lawn crypt lid or other support surface so as to securely mount the assembly thereto. In some implementations, the fastening system also includes an extraction slot designed to facilitate the removal process. The extraction slot preferably allows easy insertion of a prying tool to a location adjacent to the retainer. In other implementations, the assembly also includes a cover that is disposed adjacent the extraction slot and channel opening to conceal these features from view. In some other implementations, the assembly further includes a multifunction frame that is adapted to provide drainage function to the grave marker assembly as well as provide decorative elements.

In another embodiment, the present disclosure provides a system for identifying a deceased person or pet buried within a vault that defines a space for receiving at least one deceased person or pet. The vault includes an upper surface having a receiving opening and wherein the upper surface is positioned a first distance from the level of the ground. The system generally comprises a base having a lower surface and an upper surface, wherein the upper surface is adapted to receive an identification marker for the at least one deceased person or pet. The base also defines a plurality of side edges. At least one of the side edges includes an opening that extends into the base wherein a channel is formed on the bottom surface of the base so as to be in communication with the opening along the length of the opening, wherein the width of the channel is smaller than the width of the opening. The system further comprises a retainer that has a head of a first width and a shaft of a second width, less than the first width, wherein the head of the retainer is positioned into the opening of the base so that the shaft extends through the channel wherein the shaft of the retainer includes biasing members such that the shaft, when extended through the channel engages with the receiving opening of the vault so as to retain the base in contact with the vault.

In a preferred embodiment, the biasing members on the retainer are deformable and the base includes an extraction slot positioned on a side surface that allows a user to pry the base out of engagement with the receiving opening of the vault. In another preferred embodiment, the biasing members comprise a plurality of flexible members that extend outward and upward from the shaft of the retainer so that the biasing members engage the inner surface of the receiving opening to inhibit removal of the retainer from the receiving opening. In yet another embodiment, the biasing members are formed of a deformable material so that the biasing members can be deformed to permit removal of the retaining member from the receiving opening.

In another preferred embodiment, the system further comprises a cover that covers the opening in the side wall of the base and the extraction slot so as to hide the opening and extraction slot from view. In another preferred embodiment, the system further comprises at least one edge piece that is secured to the base adjacent at least one of the sides of the base. In yet another embodiment, the at least one edge piece defines a frame piece that frames the identification marker of the deceased person or pet. In yet another preferred embodiment, the a portion of the frame member is positioned on the upper surface of the base and wherein the portion of the frame member includes at least one aperture that extends to the side surface of the base so that water accumulating on the upper surface of the base drains through the aperture and into the ground adjacent the side of the base.

DETAILED DESCRIPTION OF THE PREFERRED EMBODIMENT

Figure 1:
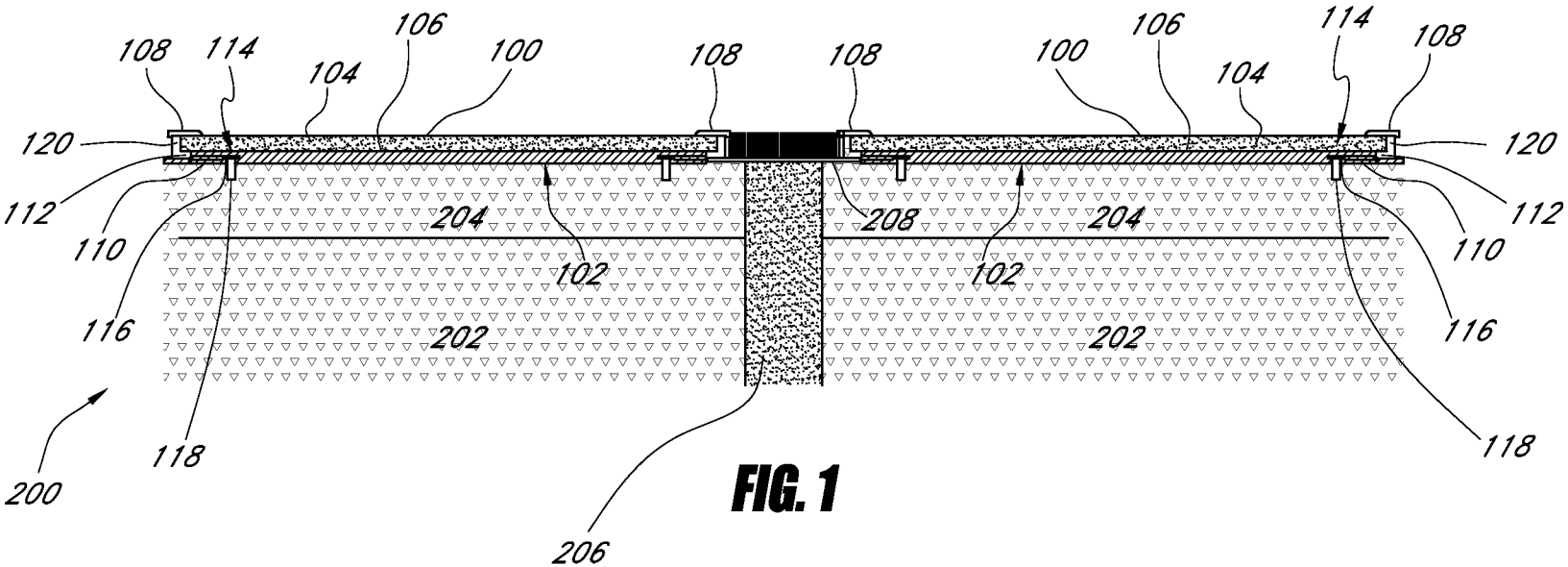
FIG. 1 is a schematic illustration of a grave marker assembly mounted to a lawn crypt system according to a preferred embodiment of the present invention.

References will now be made to the drawings wherein like numerals refer to like parts throughout. FIG. 1 is a schematic illustration of a grave marker assembly 100 of one preferred embodiment used in conjunction with a lawn crypt system 200 which includes a plurality of single or double depth crypts 202 each covered with a crypt lid 204. In some implementations, pea gravel and sand 206 fill the space between adjacent crypts 202 and artificial turf 208 can be placed on the ground between adjacent crypt lids.

As shown in FIG. 1, the grave marker assembly 100 is mounted on an upper surface of the crypt lid 204. Each grave marker assembly 100 generally comprises a base 102, a memorial marker 104 attached to an upper surface 106 of the base 102, and a frame member 108 disposed along the periphery the memorial marker 104. The base 102 can be made of a variety of material, such as fiberglass, FRP, ABS, PVC, and combinations thereof. The memorial marker 104 can be a plaque, slab, tablet or the like, and can be made of a variety of material such as marble, stone, granite, or concrete. Because the grave marker assembly 100 advantageously eliminates the need for anchoring the marker in soil, the thickness of the grave marker can be reduced. In one implementation, the thickness of the memorial marker 104 is between 16 mm and 19 mm (⅝ inch to ¾ inch), and the thickness of the base 102 is between 2 and 8 mm. The reduction in thickness in turn reduces material cost and overall weight of the assembly.

As FIG. 1 further illustrates, a channel 110 extends from a side edge 112 of the base 102 to an interior point 114 that is located preferably between 3.18 mm to 76.2 mm (⅛ inch to 3 inches), more preferably 25.4 mm to 76.2 mm (1 inch to 3 inches), more preferably 25.4 mm (1 inch) from the side edge 112. An opening 116 is formed in the base 101 at the interior point 114. As will be described in greater detail below, the channel 110 and the opening 116 are adapted to receive a fastening device for securing the assembly to the crypt lid 204 or other similar support surface. The grave marker assembly 100 comprises one or more fastening devices 118 adapted to removably mount and secure the base 102 to the upper surface of the crypt lid 204. In one implementation, the fastening device 118 is a fastening screw configured to be slipped through the channel 110 in the base 102 to the opening 116 located at the interior point 114. The fastening screw is configured to be seated in the opening 116. Preferably, the fastening screw is positioned at least a distance from the side edge 112 of the base so that it is not readily visible from view. In some implementations, the assembly 100 further includes a cover 120 that covers the channel opening in the base so as to conceal the channel opening from view.

Figure 2:
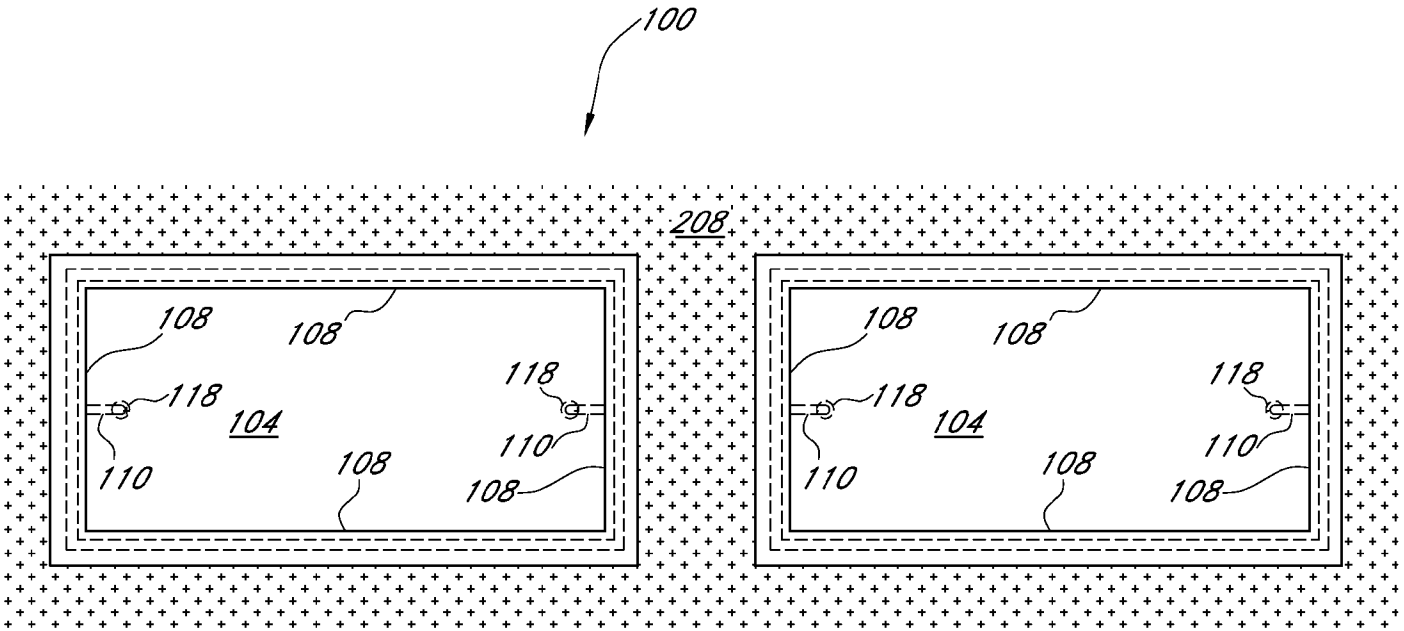
FIG. 2 is a top view of the grave marker assembly of FIG. 1.

FIG. 2 illustrates a top view of the grave marker assembly 100. As shown in FIG. 2, the memorial marker 104 is securely attached to the crypt lid (not shown) and flush with the grass, artificial turf 208, or the like located above the crypt. As further shown, the frame member 108 is disposed around the outer edges of the memorial marker 104. The frame member can be made of a decorative design and can be made of a variety of different materials such as granite, metal, or a combination thereof. As also shown in FIG. 2, the fastening device 118 is seated below the memorial marker 104, in an opening located on the interior end of the channel 110. As such, the fastening device is not readily accessible by vandals or those who do not know the location of the fastening device.

Figure 3A:
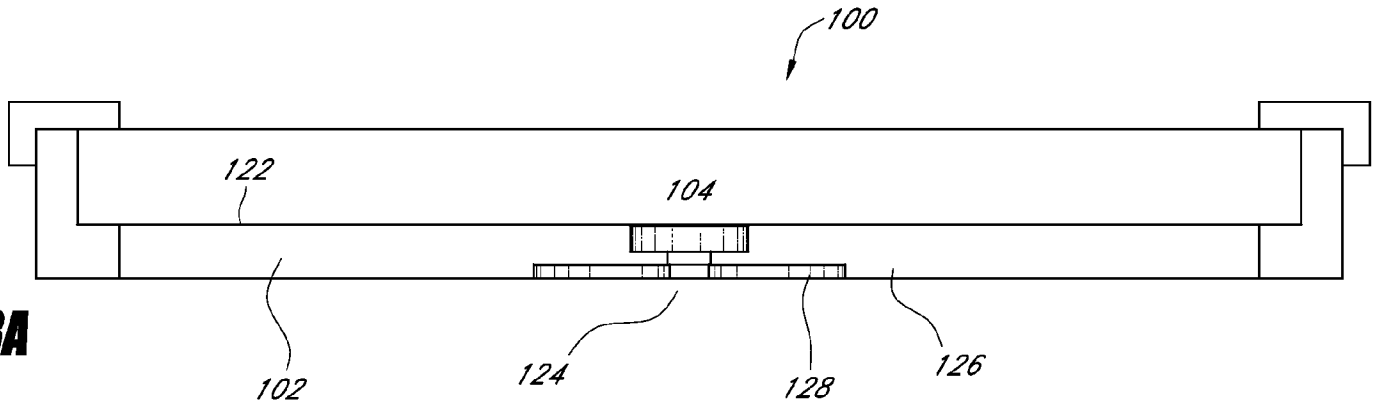
FIG. 3A illustrates a cross-sectional view of a grave marker assembly of one embodiment.
Figure 3B:
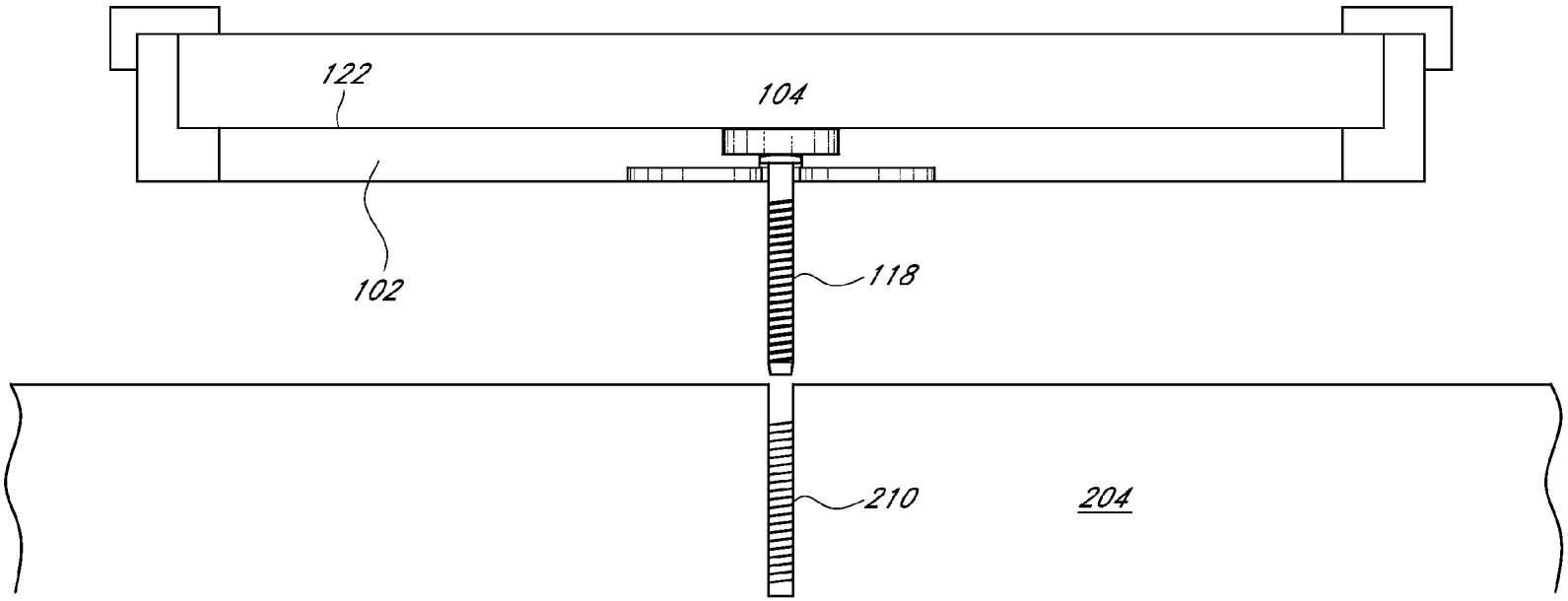
FIG. 3B illustrates a cross-sectional view of a grave marker assembly of one embodiment having a retainer being mounted to a crypt lid or other support surface.

FIG. 3A illustrates a detailed cross-sectional view of the grave marker assembly 100. As shown in FIG. 3A, the memorial marker 104 is attached to an upper surface 122 of the base 102. The base 102 has an opening 124 formed on a side edge 126 which leads to a channel extending inwardly from the side edge 126. An extraction slot 128 is also formed along the side edge 126 to facilitate extraction of the fastener 118 with a prying device. As shown in FIG. 3B, in some implementations, the fastener is a fastening screw that is extended though the channel and received into an interior opening. Once the head of the fastening screw is securely seated in the interior opening, the stem of the fastening screw is inserted into an opening 210 formed on the crypt lid 204. In other embodiments, the fastening screw can be inserted into openings formed on other support structures, such as a concrete block or the like.

Figure 4:
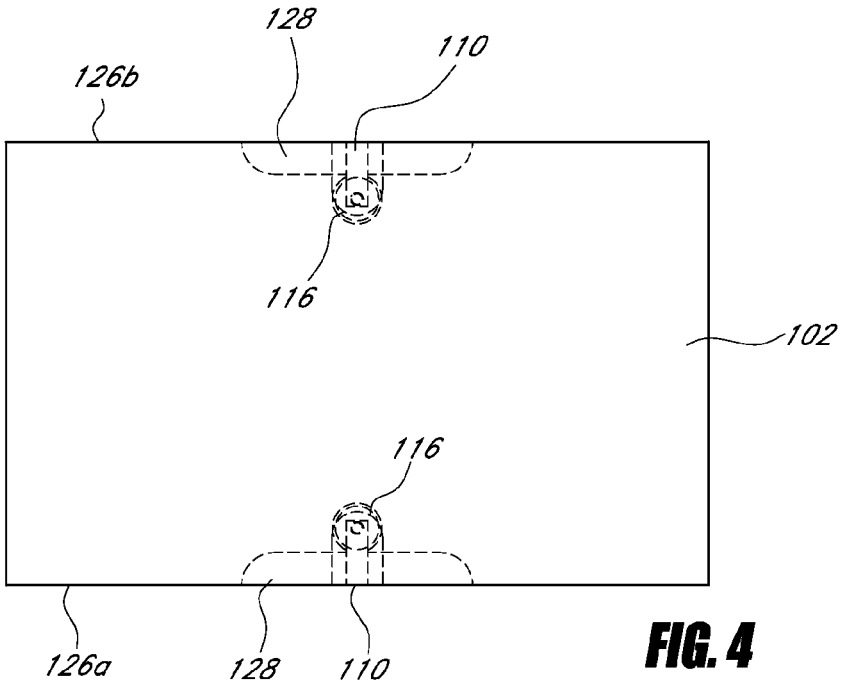
FIG. 4 illustrates a schematic illustration of a top view of a base of the grave marker of FIG. 1.
Figure 5:
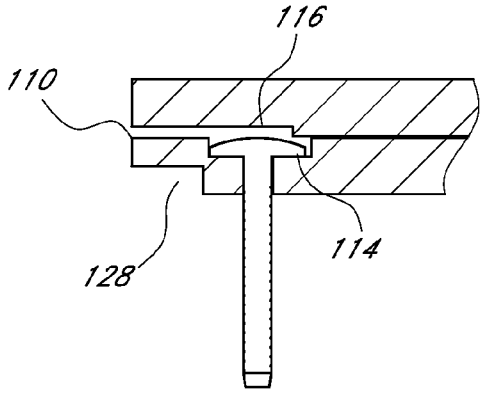
FIG. 5 schematically illustrates a side view of the retainer being engaged with the opening in the base of the grave marker assembly.
Figure 4A:
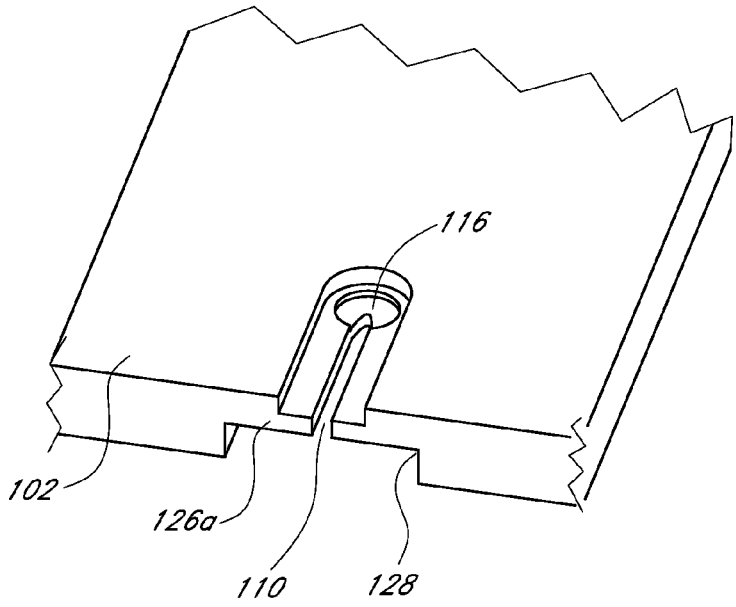
FIG. 4A illustrates a cross-sectional view of the base shown in FIG. 4.

FIG. 4 shows a top view of the base 102, further illustrating the channels, slots, and openings configured to accommodate the installation and securing of the fastening device. As shown in FIG. 4, each channel 110 extends from a side edge 126*a*, 126*b* to an interior slot 116. The extraction slot 128 can be formed along each side edge 126*a*, 126*b* adjacent to the channels 110. As shown in FIG. 5, in one embodiment, the interior slot 116 is biased at a slightly lower level than the channel 110 so that the fastening device can be securely seated in the slot 116. The extraction slot 128 preferably extends along the side edge to facilitate prying of the assembly to remove the assembly from the crypt lid or other support surface.

Figures 6, 6A:
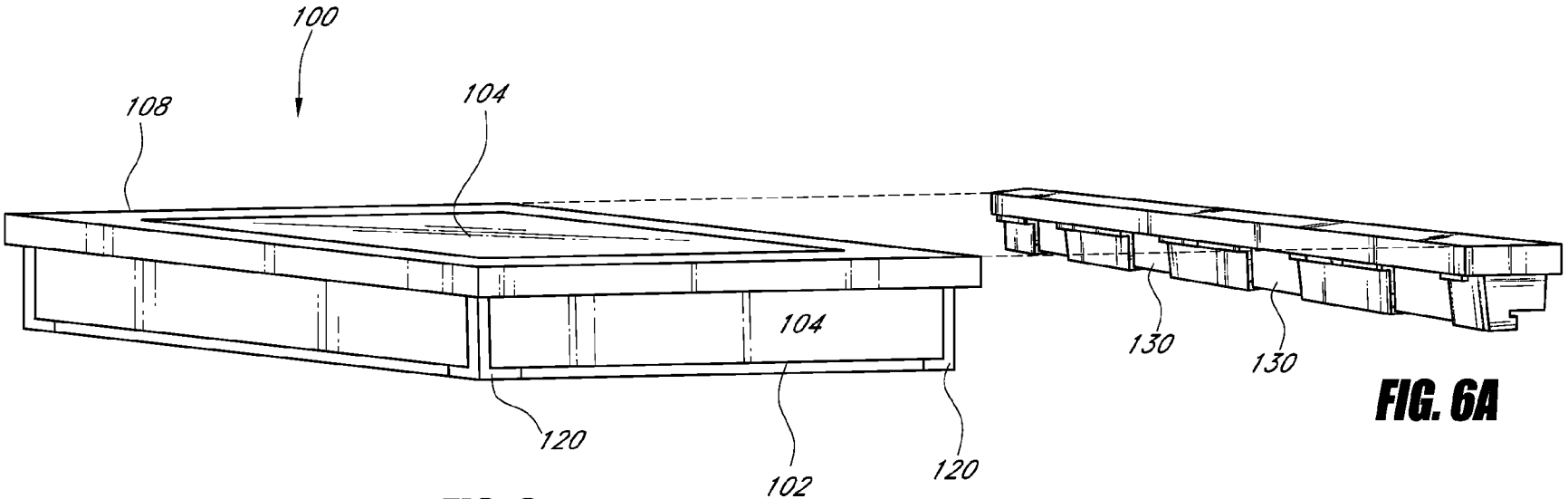
FIG. 6 is a perspective view of a grave marker assembly of one preferred embodiment showing the frame of one embodiment.
FIG. 6A is a sectional view of the frame, showing the drainage channels.

FIG. 6 is a perspective view of the grave marker assembly 100 complete with the frame member 108. As shown in FIG. 6, the frame member 108 is removable and configured to mate with the upper edges of the memorial marker 104 so as to form a border or frame around the marker. The frame member 108 can also include decorative elements. In one embodiment, as shown in FIG. 6A, the frame member 108 also serves drainage function by providing spaced apart grooves 130 that allow water to flow from the top of the memorial marker 104 through the grooves into the ground. As also shown in FIG. 6, in some embodiments, removable covers 120 positioned on the side edges of the base 102 and memorial marker 104 hide the fastening device from view.

Figure 7:
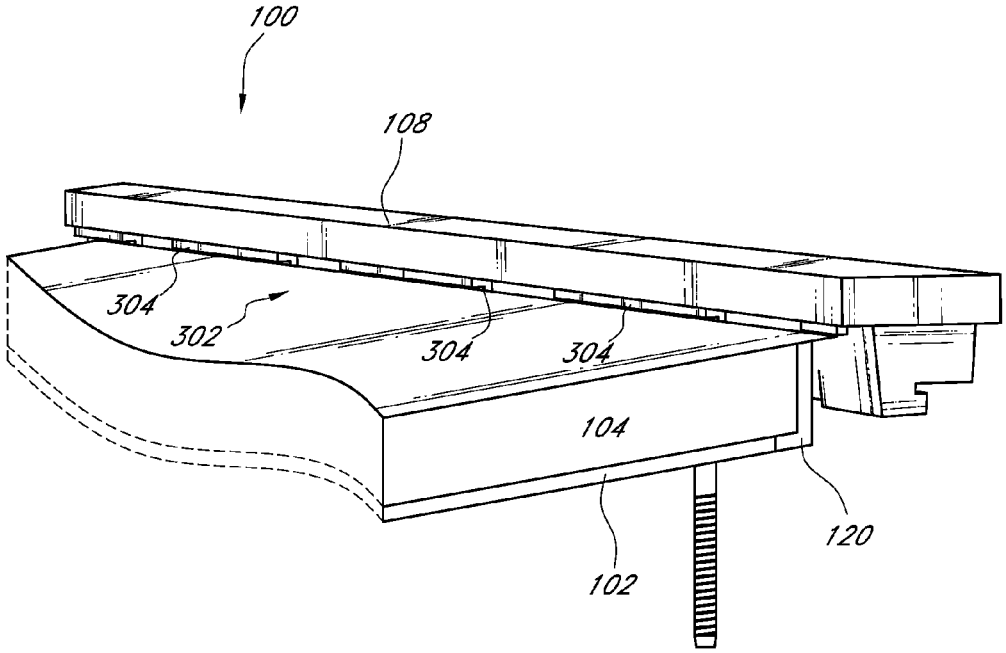
FIG. 7 schematically illustrates the manner in which water can be drained from the surface of the marker.

FIG. 7 is a partial perspective section view of the grave marker assembly 100, illustrating the drainage function provided by the frame member 108. As shown in FIG. 7, water 302 accumulated on the upper surface of the memorial marker 104 can flow down spaced apart grooves 304 between the frame member 108 and the memorial marker 104. The grooves 304 provide a path for water to flow downwardly through the side edges and into the ground.

Advantageously, the grave marker assembly according to the preferred embodiments incorporates a fastening mechanism that allows easy installation and removal of the grave marker from a support surface such as a lawn crypt lid. The fastening mechanism is also concealed from view so as to prevent vandals and thieves from removing the grave marker.

The foregoing description of the preferred embodiment of the present invention has shown, described and pointed out the fundamental novel features of the invention. It will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by appended claims.

What is claimed is:

1. A grave marker assembly, comprising: a memorial marker; a base member having an upper surface and a lower surface, wherein the base member comprises an opening that extends laterally into the base member from a side edge, a lateral channel formed on the lower surface of the base member so as to be in communication with the opening along the length of the opening, an interior slot formed adjacent the lateral channel, said interior slot having a lower support surface and a sidewall extending therefrom, wherein the lower support surface of the interior slot is biased at a slightly lower level than the lateral channel so as to provide a seat; and a fastener comprising an upper portion and a lower portion, wherein the width of the upper portion is greater than the width of the lower portion, wherein the fastener is adapted to be moved laterally through the lateral channel to the interior slot which is adapted to seat and inhibit movement of the upper portion of the fastener.

2. The grave marker assembly of claim 1, further comprising a removable frame member.

3. The grave marker assembly of claim 2, wherein the removable frame member comprises spaced apart interior grooves adapted to drain water from an upper surface of the memorial marker.

4. A system for identifying a deceased person or pet buried within a vault that defines a space for receiving at least one deceased person or pet wherein the vault includes an upper surface that has a receiving opening and wherein the upper surface is positioned a first distance from the level of the ground, the system comprising:

a base that has a lower surface and an upper surface that is adapted to receive an identification marker for the at least one deceased person or pet, wherein the base defines a plurality of side edges and wherein at least one of the side edges includes an opening that extends into the base, wherein a lateral channel is formed on the lower surface so as to be in communication with the opening along the length of the opening, wherein the width of the channel is smaller than the width of the opening, wherein an end portion of the lateral channel is biased at a slightly lower level than the lateral channel so as to provide a seat, said end portion comprises a lower support surface and a sidewall extending therefrom, wherein the lower support surface is positioned at a slightly lower level;

a retainer that has a head of a first width and a shaft of a second width, less than the first width, wherein the head of the retainer is positioned into the opening of the base so that the shaft extends laterally through the lateral channel, wherein the head of the retainer includes biasing members such that one end of the shaft, when extended through the lateral channel engages with the receiving opening of the vault so as to retain the base in contact with the vault.

5. The system of claim 4, wherein the biasing members on the retainer are deformable and the base includes an extraction slot positioned on a side surface that allows a user to pry the base out of engagement with the receiving opening of the vault.

6. The system of claim 5, further comprising a cover that covers the opening in the side edge of the base and the extraction slot so as to hide the opening and extraction slot from view.

7. The system of claim 4, wherein the biasing members comprise a plurality of flexible members that extend outward and upward from the shaft of the retainer so that the biasing members engage the inner surface of the receiving opening to inhibit removal of the retainer from the receiving opening.

8. The system of claim 7, wherein the biasing members are formed of a deformable material so that the biasing members can be deformed to permit removal of the retaining member from the receiving opening.

9. The system of claim 4, further comprising at least one edge piece that is secured to the base adjacent at least one of the side edge of the base.

10. The system of claim 9, wherein the at least one edge piece defines a frame piece that frames an identification marker of the deceased person or pet.

11. The system of claim 10, wherein a portion of the frame member is positioned on the upper surface of the base and wherein the portion of the frame member includes at least one aperture that extends to the side surface of the base so that water accumulating on the upper surface of the base drains through the aperture and into the ground adjacent the side of the base.

* * * * *